US005163497A

United States Patent [19]

Wuepper et al.

[11] Patent Number: 5,163,497

[45] Date of Patent: * Nov. 17, 1992

[54] METHOD OF AND APPARATUS FOR FORMING SAND MOLDS

[75] Inventors: Thomas E. Wuepper, Alger; Keith R. Grauherr, Twining; Orren R. Tate, Cadillac; Alfred D. Philo, Manton, all of Mich.

[73] Assignee: CMI International, Inc., Southfield, Mich.

[ * ] Notice: The portion of the term of this patent subsequent to Dec. 11, 2007 has been disclaimed.

[21] Appl. No.: 611,920

[22] Filed: Nov. 13, 1990

Related U.S. Application Data

[63] Continuation of Ser. No. 480,302, Feb. 15, 1990, Pat. No. 4,976,303.

[51] Int. Cl.[5] ..... B22C 15/02; B22C 15/08

[52] U.S. Cl. ..... 164/29; 164/37; 164/172; 164/173

[58] Field of Search ..... 164/29, 37, 172, 173, 164/207

[56] References Cited

U.S. PATENT DOCUMENTS

| | | | |
|---|---|---|---|
| 346,380 | 7/1886 | Moore | 164/173 |
| 364,948 | 6/1887 | Moore | 164/173 |
| 1,025,789 | 5/1912 | Davis et al. | 164/172 |
| 3,586,093 | 6/1971 | Young | 164/37 X |
| 3,760,866 | 9/1973 | Larkin | 164/207 X |
| 4,976,303 | 12/1990 | Wuepper et al. | 164/29 |

FOREIGN PATENT DOCUMENTS

| | | | |
|---|---|---|---|
| 639735 | 12/1936 | Fed. Rep. of Germany | 164/172 |
| 59-73149 | 4/1984 | Japan | 164/172 |
| 60-83742 | 5/1985 | Japan | 164/37 |
| 60-145245 | 7/1985 | Japan | 164/37 |
| 399293 | 2/1974 | U.S.S.R. | 164/207 |

*Primary Examiner*—J. Reed Batten, Jr.
*Attorney, Agent, or Firm*—Harness, Dickey & Pierce

[57] ABSTRACT

A sand mold forming machine has a cope frame aligned above a drag frame with a pattern arranged between, and within, the frames. A sand filling is positioned in each of the frames. The sand fillings are compacted by squeeze plates overlaying the open, upper and lower ends of the cope and drag respectively. The squeeze plates are moved towards each other to compress the sand within the frames and against the pattern. Each of the squeeze plates is made of numerous, separate sections that are mounted upon a movable platten. The sections, of each plate, may move together as a group by moving the plattens or, the sections may be individually moved, relative to the plattens. Thus, pre-selected area of the sand fillings may be compacted more or less, as desired, than adjacent areas by separately moving opposing sections relative to the overall squeezing movements of the squeeze plate.

3 Claims, 1 Drawing Sheet

METHOD OF AND APPARATUS FOR FORMING SAND MOLDS

This is a continuation application of application Ser. No. 07/480,302 filed Feb. 15, 1990 and now U.S. Pat. No. 4,976,303.

BACKGROUND OF INVENTION

The casting of molten metal in sand molds conventionally involves the steps of compacting sand in a flask, around a pattern, then removing the pattern to form a molding cavity within which molten metal is cast and solidified. The flask comprises an upper, cope frame and a lower, drag frame which are aligned, one above the other, with the pattern arranged between and within them. Sand is packed into the frames, around the pattern, to form cope and drag mold sections. Then, these sections are separated, the pattern is removed, and the sections placed together to provide the mold cavity therebetween.

In production type foundries in which numerous identical castings are made, it is common to from the sand casting molds within mold making machines. In using such machines, a match plate having pattern halves on each of its faces is positioned beneath the open bottom of a drag frame and sand is dumped into the open top of the frame. Then the drag frame is inverted so that the match plate is on the now upper, inner end of the drag frame.

Next, a cope frame is positioned, in alignment, upon the drag frame and match plate and sand is dumped into the open, upper end of the cope frame. Then, squeeze plates, which are plates positioned upon the open upper, end of the cope and the open, lower end of the drag, are pressed towards each other to compact the sand within each of the frames towards the match plate and the pattern.

After the sand is suitably compacted within the cope and drag frames, the two frames are separated and the match plate, with the pattern, is removed. After that, the cope and drag frames, filled with the compacted sand fillings, are realigned to provide the closed cavity, from which the pattern had been removed, within which molten metal may be cast.

The density or compactness of the sand filling within the sand mold depends upon the amount of force applied to the squeeze plates and the degree of movement of the plates towards each other for squeezing the cope and drag fillings between them. Because the production of sand molds within a sand mold machine is automated, and the molds are very rapidly produced, as for example, four to five molds per minute, it has not been feasible to very the degree of compacting of the sand filling within a mold. That is, a substantially uniform, sand density or compactness is obtained by the machine formation of sand molds. But, in many sand casting operations, it is desirable to vary the amount of compactness or density of the sand mold within different parts of the mold. For example, it may be desirable to have a harder, more dense area at different parts of the pattern for better and more effective casting purposes. This has not been feasible with available sand mold making machines.

There has been a need for a means for providing different density areas within said casting molds that are formed by mold making machines. Thus, this invention relates to an improved squeeze plate construction and method of operation by which the density and, consequently, the hardness, of the compacted sand within a sand casting mold may be varied, as desired.

SUMMARY OF INVENTION

This invention contemplates forming the mold making machine squeeze plates, that compact the sand fillings within aligned cope and drag frames, of numerous, block-like, closely arranged, coplanar sections. These sections may be separately or individually moved, as well as moved as a group with the other sections. Each squeeze plate is mounted upon a platten by an expandable and contractable connector. Consequently, the opposing cope and drag plattens may be moved towards and away from the match plate, which is located between the cope and drag frames. Hence, the squeeze plates each act as a single plate unit to compact the sand within the respective frames. However, the individual squeeze plate sections may be separately moved to greater or lesser degrees toward the match plate, i.e., towards the corresponding opposite sections on the opposite squeeze plate, for compacting the sand in localized areas to a greater or lesser degree.

Preferably, each platten is formed of a pair of spaced apart, parallel plates which are interconnected by numerous fluid operated cylinders. Each cylinder contains a piston and a piston rod extending outwardly of one of the platten plates and connected to one section of the sectional squeeze plate. Fluid actuation of pre-selected cylinders causes their pistons to move for transmitting the movement through their piston rods to their specific sections. That results in the sections moving separately or independently of other sections. Consequently, all of the sections may be moved together as a single entity, by moving the platten plates or, alternatively, may be moved independently by actuating the separate section connector.

An object of this invention is to provide a means for varying the density or compactness of pre-selected areas of a sand casting mold formed within the cope and drag frames of the sand casting machine flask, by means of sectionalizing the squeeze plates and independently moving pre-selected sections, relative to other sections, for varying the degree of squeeze pressure applied to the sand within the flask.

Another object of this invention is to provide a means and method for easily, inexpensively, and very rapidly adjusting the density of the compacted sand within predetermined locations within a sand casting mold.

Yet another object of this invention is to provide a mechanism which may be incorporated within a conventional sand mold making machine, for producing varying density sand molds during the otherwise regular operation of the machine in the manufacture of sand casting molds.

Yet a further object of this invention is to provide a sectionalized squeeze plate which may be mounted within a conventional mold forming machine for providing varying density sand casting molds, without materially changing the construction or operation of the mold forming machine and with relatively small expense.

These and other objects and advantages of this invention will become apparent upon reading the following description, of which the attached drawings form a part.

DETAILED DESCRIPTION

Figure 1:
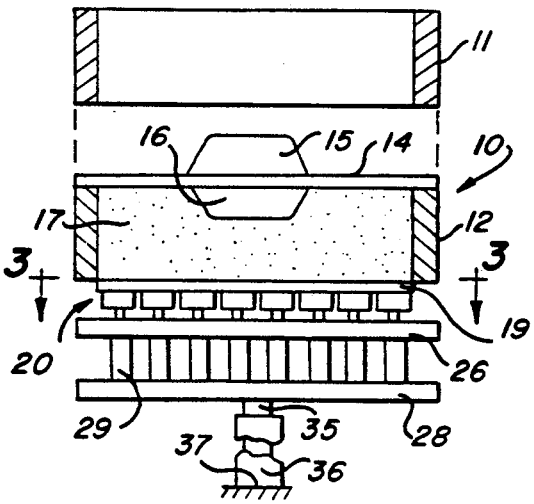
FIG. 1 is a schematic, partially cross-sectioned illustration of a sand-filled drag frame positioned upon a sectional squeeze plate, with the cope frame spaced a short distance above the drag and a match plate.
Figure 2:
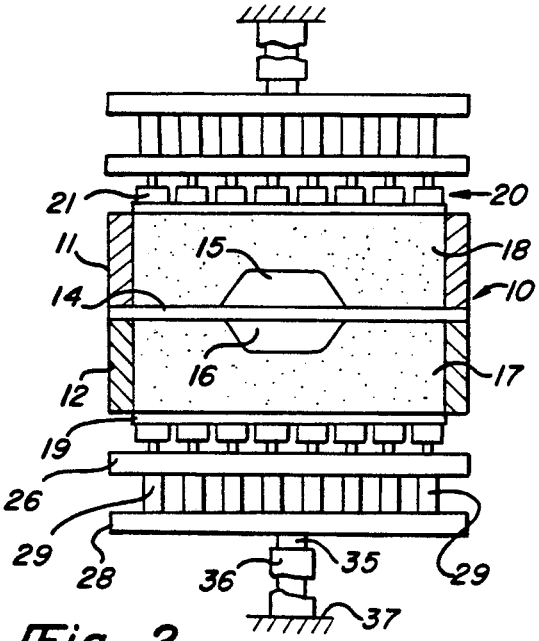
FIG. 2 is a schematic, partially cross-sectioned illustration showing the cope and drag frames closed together upon the match plate and the pattern, with both frames filled with sand and positioned between the upper and lower sectional squeeze plates.
Figure 3:
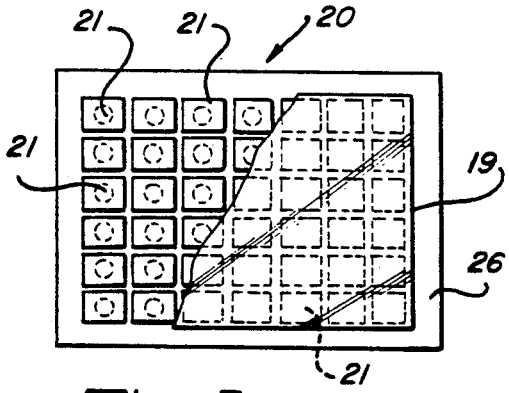
FIG. 3 is a schematic, elevational view taken in the direction of arrows 3—3 of FIG. 1, showing the upper surface of the lower squeeze plate, and with the resilient cover sheet partially removed.

FIGS. 1 and 2 schematically illustrate a flask 10 formed of a cope frame 11 and a drag frame 12. A match plate 14 is arranged between the adjacent, mating edges of the cope and drag (see FIG. 2). The match plate carries the upper pattern half 15 and lower pattern half 16 which together will form the casting cavity in the sand mold.

The drag contains a sand filling 17 (see FIG. 1) and the cope contains a sand filling 18 (see FIG. 2). The outer, exposed surfaces of the sand fillings are covered by resilient, rubber-like, cover sheets 19.

The sectional squeeze plate 20 is formed of numerous, block-like or plate-like, coplanar, sections 21. These sections are arranged closely together so that they form a substantially complete squeeze plate surface. However, for illustration purposes, the sections are gapped apart exaggerated distances.

Each of the squeeze plate sections is mounted upon a piston rod 24 which is journaled through an opening 25 in an inner platten 26. This platten is connected to an outer platten 28. The two plattens are connected together by fluid actuated cylinders 29, which may be hydraulically or pneumatically operated cylinders. Each cylinder contains a piston 30 connected to the end of one of the piston rods 24.

Suitable fluid inlet-outlet lines 31 are connected to each of the cylinders at their outer ends and similar fluid inlet-outlet lines 32 are connected at the inner ends of the cylinders.

The outer plattens 28 each are provided with a platten piston rod 35 engaged with a piston (not shown) located within a platen moving cylinder 36 which may be hydraulically or pneumatically operated. That cylinder is secured on a suitable support 37, shown schematically (see FIG. 2).

In operation, in a typical mold forming machine, the drag 12 is supported upon rails (not shown) located adjacent the squeeze plate. The drag may be placed upon the match plate 14. At that point, loose, foundry casting sand is dumped into the drag to loosely fill it. The drag is turned upside down so that the match plate is now on its upper edges, as illustrated in FIG. 1. Then, the drag is moved, on the rails, into the portion of the machine where the squeeze plate is located. In this instance, the lower, exposed sand surface of the drag may be covered with the rubber-like, resilient sheet 19. The sheet may be applied upon the drag, before it is turned upside down, to prevent the sand from falling out when the drag is inverted.

When the drag is located upon the lower sectional squeeze plate 20, as illustrated in FIG. 1, the cope frame 11 is positioned above the drag and then lowered into position. As usual, the cope and drag adjacent edges are engaged against each other or against the match plate. Then, foundry sand is dumped into the cope frame to fill it. After that, the upper squeeze plate is moved into position above the cope frame, with a resilient rubber-like sheet 19 placed upon the upper surface of the filling in the cope frame.

As illustrated in FIG. 2, the sand filled cope and drag frames are positioned between the opposed, upper and lower sectional squeeze plates 20. At that point, the plattens 28 are moved, by means of their hydraulic or pneumatic, fluid cylinder-piston arrangements, towards each other to squeeze the sand fillings in the cope and drag frames towards the match plate and around the pattern.

The sand within the flask cope and drag frames are compacted by the squeezing action of the opposing squeeze plates. In addition, predetermined areas of the sand fillings may be further compacted or provided with increased density, by moving pre-selected squeeze plate sections inwardly towards the match plate. Preferably, opposing sections are moved towards each other, relative to the other sections or plattens in order to compact the sand fillings located between them.

Figure 4:
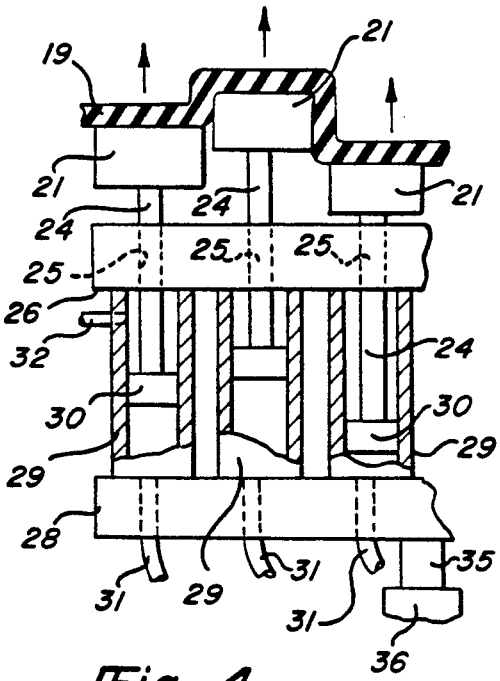
FIG. 4 is a schematic, fragmentary, enlarged view, partially in cross-section, showing several sections of the squeeze plate in different pressure applying positions, with considerable exaggeration of the positions for illustration purposes.

As shown in FIG. 4, in greatly exaggerated form, the squeeze plate sections may be moved inwardly, as indicated by the arrows, different amounts. Thus, the sand fillings are compacted, in the first instance, by the inward movement of the squeeze plates, due to the movement of their plattens and, in the second instance, by the separate or individual movement of the sections of the squeeze plate.

Figure 5:
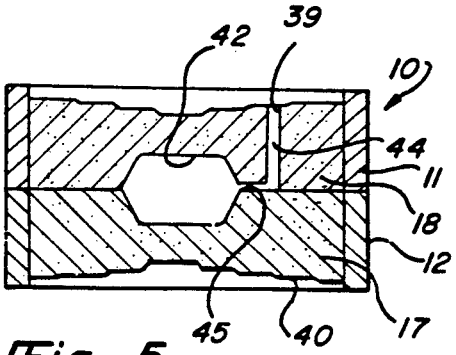
FIG. 5 is a cross-sectional view of a mold with the upper and lower surfaces of the sand filling exaggerated to illustrate the differential pressure applications produced by the sectional squeeze plate.

FIG. 5 illustrates, in considerably exaggerated form, the cope sand outer surface 39 and the drag sand outer surface 40 compressed inwardly in varying amounts to schematically illustrate the different areas of the sand fillings which may be more dense, that is, harder, than others.

After the sand fillings are compacted within the cope and drag frames, the squeeze plates are released, and the upper squeeze plate is moved sufficiently to permit the cope to be lifted off the drag. The match plate with the pattern halves are lifted out of the cope and drag frames. Then, the cope and drag frames are restored into aligned position, as illustrated in FIG. 5, to provide the casting cavity 42.

The assembled flask, which is schematically shown in FIG. 5, with the casting cavity may then be moved to a place where molten metal can be poured into the cavity. For this purpose, suitable openings, that is, risers 44 and gates 45 are provided in the mold. These are schematically illustrated.

Suitable controls are utilized in conventional mold making machines for moving the squeeze plates at predetermined times. These include hydraulic or pneumatic systems, having sources of pressurized fluid to operate the fluid mechanisms that move the plattens or squeeze plates into compression locations. Thus, the same or additional, commercially available controls and pressurized sources are connected to the individual section cylinders. The particular controls and pressure sources utilized are not material and may be selected by those skilled in the art. Preferably, the same pressurized fluid source and equipment that is utilized to operate the mold making machine is utilized to provide the controlled movement of pre-selected sections of the squeeze plate.

This invention may be further developed within the scope of the following claims. Accordingly, it is desired that the foregoing description be read as being merely an illustration of an operative embodiment of this invention and not in a strictly limited sense.

Having fully described an operative embodiment of this invention, we now claim:

1. A multi-sectional squeeze plate construction for use with one of the frame of a sand casting mold machine having at least one cope and drag frame, which frame has an open inner end and an open outer end with the frame inner end arranged for positioning over and around a pattern and with the frame outer end arranged to receive sand fillings which are compacted within the frame against and around the pattern to form a sand mold so that the pattern can be removed from the sand filled frame to provide a mold cavity within the sand mold, comprising:

a squeeze plate substantially completing covering the open outer end of said frame and fitting within said frame for moving within the frame towards the inner end thereof for compacting the sand filling within the frame towards and against the pattern;

a platten located outside of and overlaying the outer open end of said frame;

means for moving said platten towards and away from the inner end of said frame;

said squeeze plate being formed of numerous, plate-like sections that have pressure surfaces that are normally arranged substantially coplanar with the corresponding surfaces of the other sections for applying pressure against the sand filling;

section moving means mounted on the platten for connecting the sections to the platten and for separately moving each section towards and away from the frame inner end;

with all of the sections being moveable together by the section moving means, as a unit towards the pattern, and with each section being separately moveable relative to the platten for separately squeezing and compacting the sand in the frame to form areas of different, pre-selected compactness of sand within the frame;

a unitary, monolithic, normally flat shaped, rubber-like resilient sheet overlaying and covering all of the pressure surfaces of the sections of the squeeze plate for contacting the sand filling, between said section surfaces and the sand, within the frame;

said sheet being resiliently deformable, relative to the plane of the sheet, at each of its portions which cover each of the separate section surfaces, in response to separate movement of the section surfaces out of alignment with the other section surfaces, and said sheet being normally planar in shape when all of the sections are moved together in planar relationship, and with any deformed sheet portions being resiliently returnable to the normal, flat sheet shape upon return of the sections to their co-planar surface relationship.

2. A multi-sectional squeeze plate construction as defined in claim 1, and including said section moving means comprising connectors formed of fluid operated cylinders containing pistons which are moveable endwise of the cylinders, in response to fluid actuation of the cylinders, connecting each of the sections to the platten so that the connectors may be separately actuated by fluid pressure for separately moving the sections relative to the platten and wherein the sections, and the sheet move with the platten for simultaneous movement of all of the sections of the platten while the sections may also be independently moved relative to the platten for increasing the squeezing pressure at selected portions of the fillings.

3. A method for forming differently compacted areas within a sand casting mold having a mold cavity within which molten metal is cast, comprising the steps of:

aligning a flask frame with a pattern arranged within the flask frame and filling the flask frame with sand;

arranging a unitary, normally flat, rubber-like resilient sheet over an open end of the flask frame, with the pattern being located at an opposite open end of the flask frame;

arranging a squeeze plate formed of numerous, closely adjacent, separate, sections having sand pressure faces, which are arranged co-planar to form a substantially unitary, flat surface, overlapping the open end of the flask frame and positioned over the sheet, with the sheet arranged between the squeeze plate and the sand filling within the flask frame;

compacting the sand filling within the flask frame, towards the pattern, by moving the squeeze plate inwardly of the frame and towards the pattern for applying pressure, by each of the squeeze plate sections, to the resilient sheet for transmitting squeezing pressure through the sheet to the sand filling within the flask frame;

separately moving, pre-selected squeeze plate sections for pre-determined distances, out of the plane in which the squeeze plate sections are normally located for additionally compacting the sand towards and around the pattern, and for deforming the sheet out of its flat, planar shape in the areas of the pressure faces of the separate squeeze plate sections, in response to the separate movement of the respective squeeze plate sections and then returning the deformed sheet portions to their normal flat shape sheet, upon return of the squeeze plate sections to pressure face co-planar relationships, whereby the sand fillings within the frame are formed with portions having pre-determined greater and lesser compactness than other portions of the fillings, in response to the distance moved by their respective sections towards the pattern;

thereafter, removing the pattern to provide a mold cavity in the sand mold.

* * * * *